US010369457B2

(12) United States Patent
Holmes

(10) Patent No.: US 10,369,457 B2
(45) Date of Patent: Aug. 6, 2019

(54) PUSH BUTTON PUZZLE WITH INTERNAL LOCKING MECHANISM, DUAL ROTORS, ADJUSTABLE WEIGHTS AND A SIMPLIFIED RESET

(71) Applicant: Mark J Holmes, Haymarket, VA (US)

(72) Inventor: Mark J Holmes, Haymarket, VA (US)

( * ) Notice: Subject to any disclaimer, the term of this patent is extended or adjusted under 35 U.S.C. 154(b) by 0 days.

(21) Appl. No.: 15/926,816

(22) Filed: Mar. 20, 2018

(65) Prior Publication Data

US 2018/0264352 A1 Sep. 20, 2018

Related U.S. Application Data

(60) Provisional application No. 62/473,487, filed on Mar. 20, 2017.

(51) Int. Cl.
*A63F 9/08* (2006.01)
*A63F 9/34* (2006.01)

(52) U.S. Cl.
CPC ..... *A63F 9/0826* (2013.01); *A63F 9/34* (2013.01); *A63F 2250/24* (2013.01)

(58) Field of Classification Search
CPC .. A63F 9/0826; A63F 9/08; A63F 9/06; A63F 9/34; A63F 2250/24
See application file for complete search history.

(56) References Cited

U.S. PATENT DOCUMENTS 2,905,474 A * 9/1959 Jahr ..... A63F 9/12 273/153 R
3,813,099 A * 5/1974 Scott ..... A63F 9/12 273/156
4,397,466 A * 8/1983 Nichols ..... A63F 9/088 273/156
4,811,948 A * 3/1989 Gutierrez ..... A63F 9/12 273/156
5,035,430 A * 7/1991 Suzuki ..... A63F 9/08 273/153 R
5,125,661 A * 6/1992 Jarboe ..... A63F 9/12 273/156
5,330,186 A * 7/1994 Jones ..... A63F 9/08 273/153 S
5,419,558 A * 5/1995 Jones ..... A63F 9/08 273/153 S
5,564,703 A * 10/1996 McGuire ..... A63F 9/12 273/153 S
6,027,116 A * 2/2000 Patermann ..... A63F 9/0834 273/153 S
8,651,487 B2 * 2/2014 Holmes ..... A63F 9/08 273/153 S
9,238,170 B1 * 1/2016 Holmes ..... A63F 9/08
2009/0039600 A1 * 2/2009 Lucas ..... A63F 9/1204 273/160

* cited by examiner

*Primary Examiner* — Steven B Wong

(74) *Attorney, Agent, or Firm* — Clyde R Christofferson, Esq.

(57) ABSTRACT

In a puzzle toy having a plurality of push buttons, a mechanism for latching push buttons to a rotor, where rotation of the rotor sets a predetermined order for pushing buttons to solve the puzzle, and a chance mechanism for rotating the rotor, an improvement that partitions a rotor shaft and the rotor into two segments that rotate independently, responsive to separate weights affixed to each shaft segment. A reset mechanism operates by shifting the rotor along the shaft axis.

20 Claims, 21 Drawing Sheets

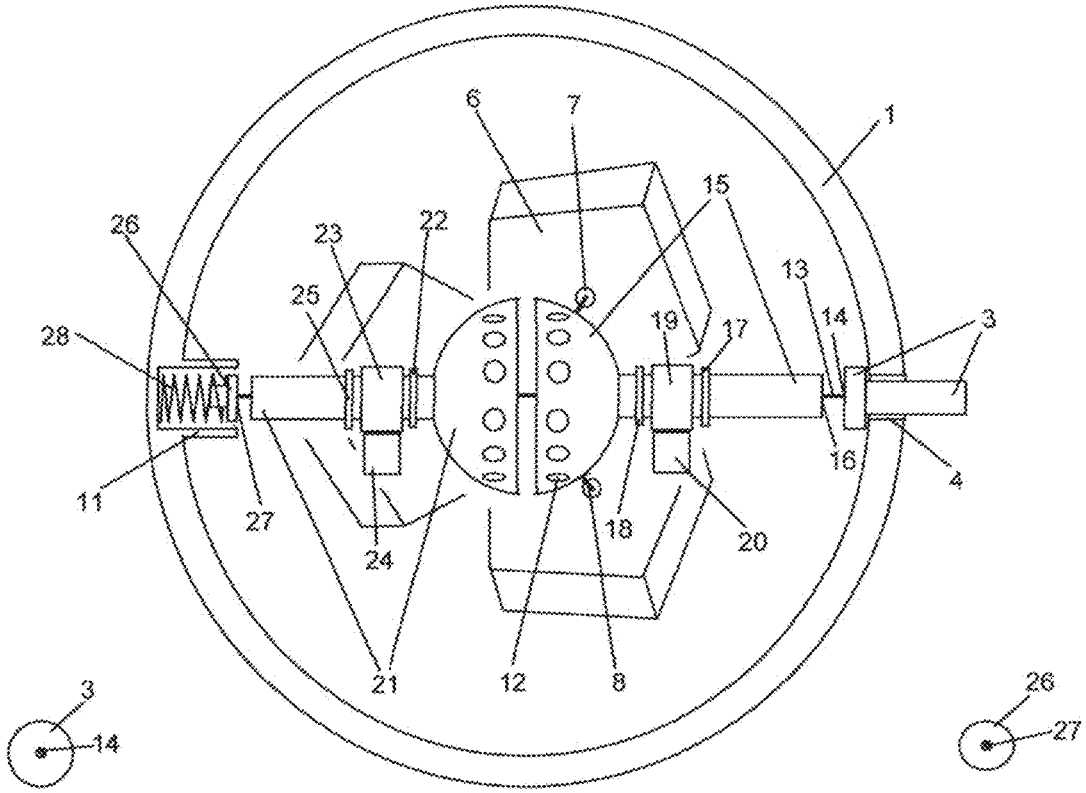
Fig 19A
Fig 19
Fig 19D
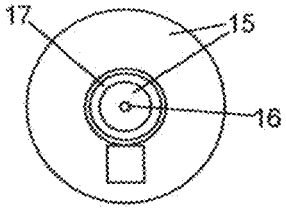
Fig 19B
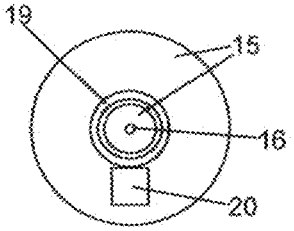
Fig 19C
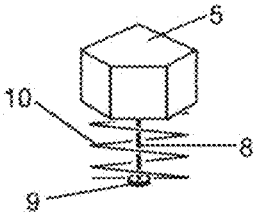
Fig 20
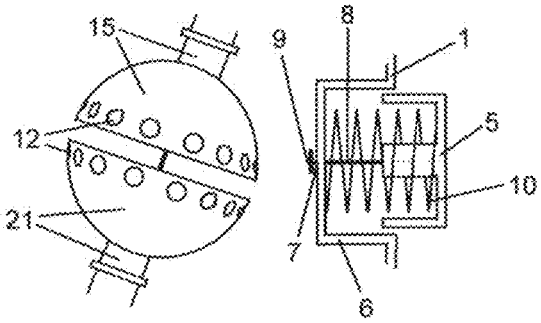
Fig 21
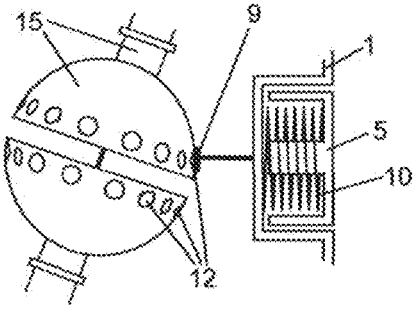
Fig 22

PUSH BUTTON PUZZLE WITH INTERNAL LOCKING MECHANISM, DUAL ROTORS, ADJUSTABLE WEIGHTS AND A SIMPLIFIED RESET

This application claims priority from U.S. Provisional Patent Application No. 62/473,487 titled "IMPROVED PUSH BUTTON PUZZLE WITH INTERNAL LOCKING MECHANISM, DUAL ROTORS, ADJUSTABLE WEIGHTS AND A SIMPLIFIED RESET" filed on Mar. 20, 2017.

BACKGROUND OF THE INVENTION

Field of the Invention

The present invention relates generally to amusement devices and toys and, more specifically to a puzzle toy having a set of projecting buttons which are pushed inwardly by a player.

Background Description

One other puzzle toy with push pins or buttons is known to exist whereby the object of the game is to push in all six projections. This puzzle is described in U.S. Pat. No. 5,035,430 to Suzuki. The problem with it is that with each push of the projections the sequence of solving the puzzle changes whereby projections pop out randomly and have to be pushed back in randomly, thus making the solving of the puzzle strictly by chance and no logic or memory plays a part.

An earlier version of the present invention, U.S. Pat. No. 8,651,487 issued Feb. 18, 2014 (the '487 patent) and U.S. Pat. No. 9,238,170 issued Jan. 19, 2016 (the '170 patent) both to the present inventor, resolved the limitation of the Suzuki patent by a latching mechanism that enforced a predetermined order for the push buttons. The earlier versions also provided a chance mechanism for unlatching any pushed buttons, a latching mechanism implemented by a rotor at the center of the toy (the '487 patent), and a reset mechanism for unlatching any pushed buttons when buttons are pushed out of the predetermined order (the '170 patent)

SUMMARY OF THE INVENTION

A goal of the present invention is to provide a plurality of push buttons which are pushed inwardly flush with the body of the toy using logic, memory and chance. After all the buttons are pushed flush, a reset button is pushed to re-project all the buttons out in their starting position.

Another goal of the present invention is to provide a puzzle that enhances the logic and memory skills of the user.

The invention is a puzzle toy that includes a plurality of push buttons that normally project from the surface of a symmetric closed body, such as a cubic or spherical body. In the preferred embodiment the shape of the puzzle is substantially symmetrical in the form of a sphere. As the buttons are pushed in one at a time a latching mechanism residing within the body holds the buttons in a pushed-inwardly state if a correct sequence of buttons is pushed, where the sequence is deduced by the player using logic and memory and chance. However, if an incorrect sequence of pushing buttons is employed all the buttons so far pushed in will all pop back out at the same time at or before the time the last button is pushed in, forcing the player to start all over. The puzzle is solved when all buttons are pushed in flush with the body of the toy.

Difficulty of the puzzle depends on the number of correct sequences to solve the puzzle, as opposed to the number of incorrect sequences. The more incorrect sequences the more difficult it is to solve the puzzle. For example, a puzzle with six buttons symmetrically arranged on the surface of a sphere has 720 possible combinations. If 719 are incorrect and only one is correct the puzzle would be exceedingly difficult to solve and vice versa.

The present invention could be mechanical or electro-mechanical or virtual. The invention could also be implemented as a cube, sphere or any number of polyhedrons with any number of buttons. The latching system could be magnetic or mechanical. In the preferred implementation the latching mechanism is magnetic.

The foundation of the invention is a puzzle solution method comprising three steps. First, presenting to a user a plurality of push buttons arrayed on the outer surface of a toy. Second, providing a latching mechanism within said toy that latches each of said plurality of push buttons in a pushed-in position provided each of a selected subset of said plurality of push buttons is pushed by the user in a predetermined order, wherein said latching mechanism unlatches any latched push buttons when one of said selected subset of push buttons is pushed-in out of said predetermined order. And, finally, a third step is providing a chance mechanism for changing the predetermined order upon the occurrence of an event unknown to the user, said event relating to user operation of said toy. The foundation of the invention may also be embodied in an apparatus having a plurality of push buttons, a latching mechanism, and a chance mechanism as described above.

In a further aspect of the invention, the event unknown to the user is user orientation of the toy in a particular direction. In some implementations of the invention the outer surface of said toy is shaped symmetrically with respect to a spatial center of said toy. In other implementations the latching mechanism is implemented using a rotor at the spatial center of said toy, the rotor having magnets of one polarity in the direction of each push button, there being a magnet of the opposite polarity on the inner side of each said button.

In yet other implementations the latching mechanism is implemented using a rotor at the spatial center of said toy, the inner side of each button having a latching arm conformable to a receiving and locking portion located on said rotor in the direction of said each button. In another implementation of the invention a user pushing in of a button out of the predetermined order causes the rotor to rotate about an axis, thereby resetting any latched buttons. In some implementations the chance mechanism is implemented by a weight which operates to reset any latched buttons if a particular one of said push buttons is pushed in when the weight is not aligned in the direction of gravity. In other implementations the chance mechanism is implemented with a gravity dependent shielding device.

In one implementation the toy is in the shape of a cube and each of six push buttons is located on a different face of said cube, there being in addition a reset button located on one of said faces. In that implementation the two push buttons at either end of a rotor axis are not within said selected subset of push buttons. In another implementation the outer surface of the toy is a sphere and each of six push buttons is symmetrically spaced on the surface of the sphere, there being in addition a reset button located on the surface of the sphere. In a variant of these implementations the reset button is operable to unlatch any latched push buttons without changing the predetermined order.

The present invention is an improvement upon the foundation invention, in a version of the invention where latching is accomplished using a rotor at the spatial center of the toy and where unlatching is accomplished by rotating a shaft which runs through the center of the rotor. In one aspect of the improvement the shaft is constructed in two segments that rotate independently around the same axis, with the latching rotor being separated into two portions along a plane running perpendicular to the shaft axis, each portion rotating with a respective shaft segment.

In a further aspect of the improvement one or both shaft segments are configured with a separate mechanism which operates by chance unknown to the user to rotate a respective portion of the latching rotor. In a preferred embodiment this mechanism is a weight affixed to a respective shaft segment such that user movement of the toy allows gravity to operate upon the weight to rotate the respective shaft segment, thereby changing the predetermined order of the push buttons. Once the first button in the predetermined order is pushed in, the magnetic force and mechanical strength of the linkage between the push button and the rotor prevent the chance mechanism from rotating the rotor.

In another aspect of the improvement the reset button is aligned along the axis of the shaft so that the reset operates by moving the rotor off center along the shaft axis. This movement is sufficient to decouple the magnetic connection between each push button and the rotor, there being sufficient tolerances and flexibility in the mechanical linkage between the push button and the rotor to absorb the stress from moving the rotor off center rather than rotating the rotor around its center.

BRIEF DESCRIPTION OF THE DRAWINGS

The foregoing and other objects, aspects and advantages will be better understood from the following detailed description of a preferred embodiment of the invention with reference to the drawings, in which:

FIG. 19 a plan view is FIG. 18 with rotor assembly installed.

FIG. 19A is a plan view and shows inside face of reset button with axle housing.

FIG. 19B is a plan view and shows the reset button side of rotor, looking down the rotor shaft to reveal axle hole.

FIG. 19C is a plan view and shows reset button side of rotor, looking down rotor shaft with a portion cutaway to reveal weight mechanism.

FIG. 19D is a plan view and shows the other axle housing, looking at side facing inward.

FIG. 20 is a perspective view of one of the buttons with shaft, spring and magnet.

FIG. 21 is a plan view of the rotors and one button (in its starting position) and their orientation to each other in the (soccer ball) sphere.

FIG. 22 is a plan view and is FIG. 21 but with the button in its "pushed in" position. The button is magnetically latched on to one of the rotors it is oriented with.

DETAILED DESCRIPTION OF A PREFERRED EMBODIMENT OF THE INVENTION

The operation of the invention can be understood by examining the flow charts shown in FIGS. 1A-1E. An embodiment of the invention for a six button mechanical puzzle is described in a flow chart labeled "6 button mechanical puzzle flow chart" shown in FIG. 1A. An embodiment describing operation of an electromechanical version of the 6 button puzzle is shown the four flow charts labeled "Chart #1", "Chart #2", "Chart #3" and "Chart #4" shown in FIGS. 1B-1E. It should be noted that the particular sequence of button pushes that solves the puzzle is set at the time of manufacture. Puzzles with different solution sequences can be manufactured, as will be understood by those skilled in the art.

Figure 1:
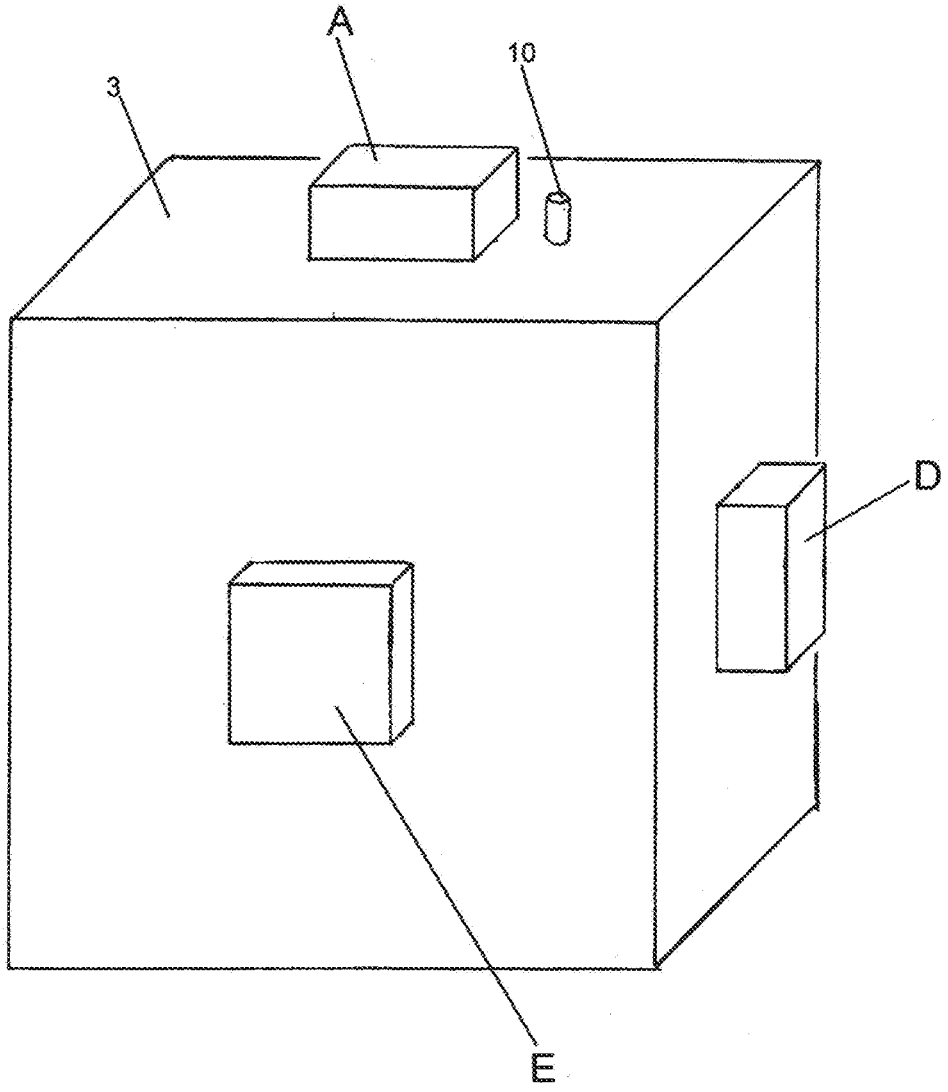
FIG. 1 is a perspective view of a preferred cubic embodiment of the present invention.
Figure 1A:
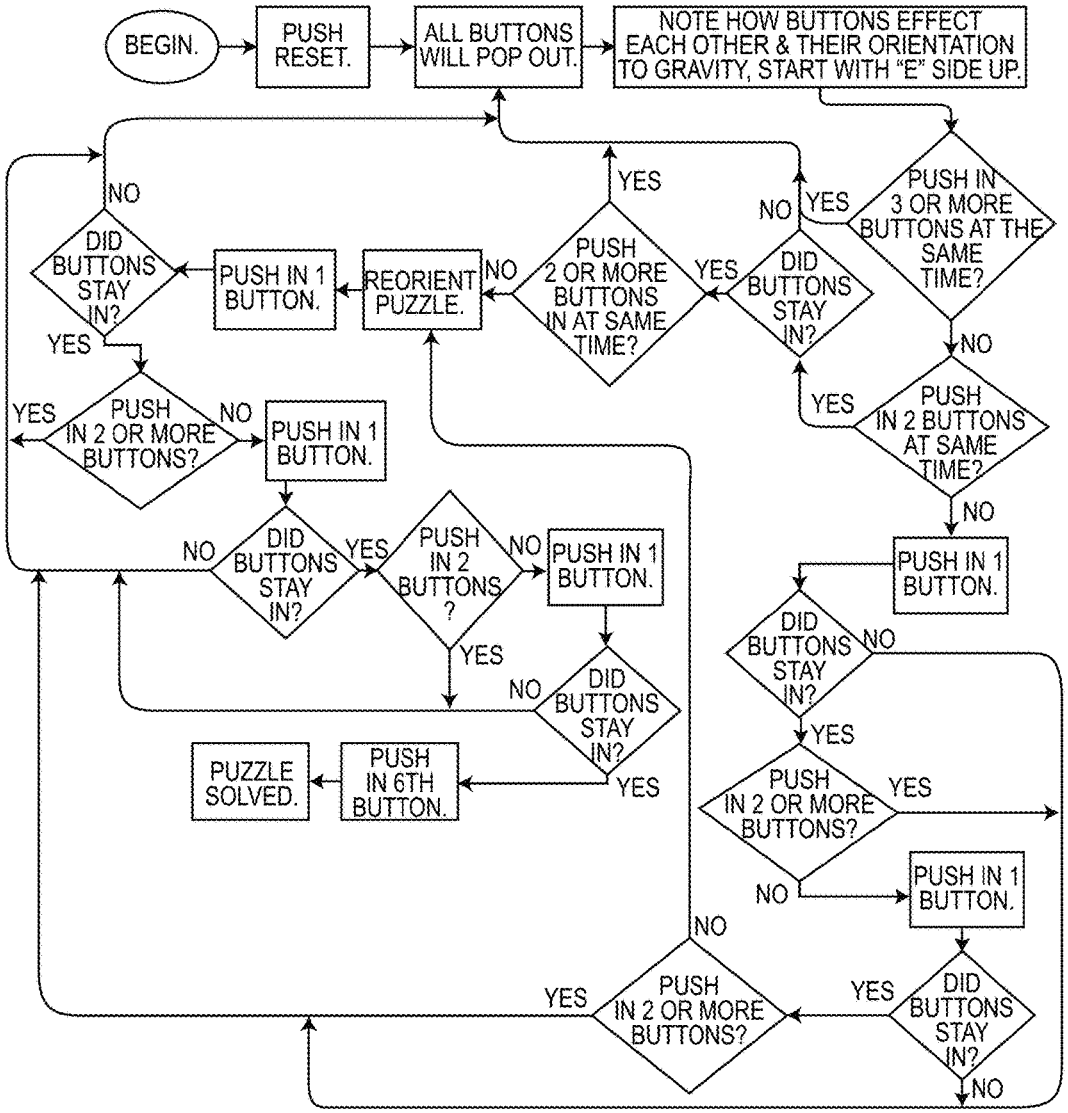
FIG. 1A is flow chart showing operation of a magnetic latching implementation of the preferred cubic embodiment of the present invention.
Figure 1B:
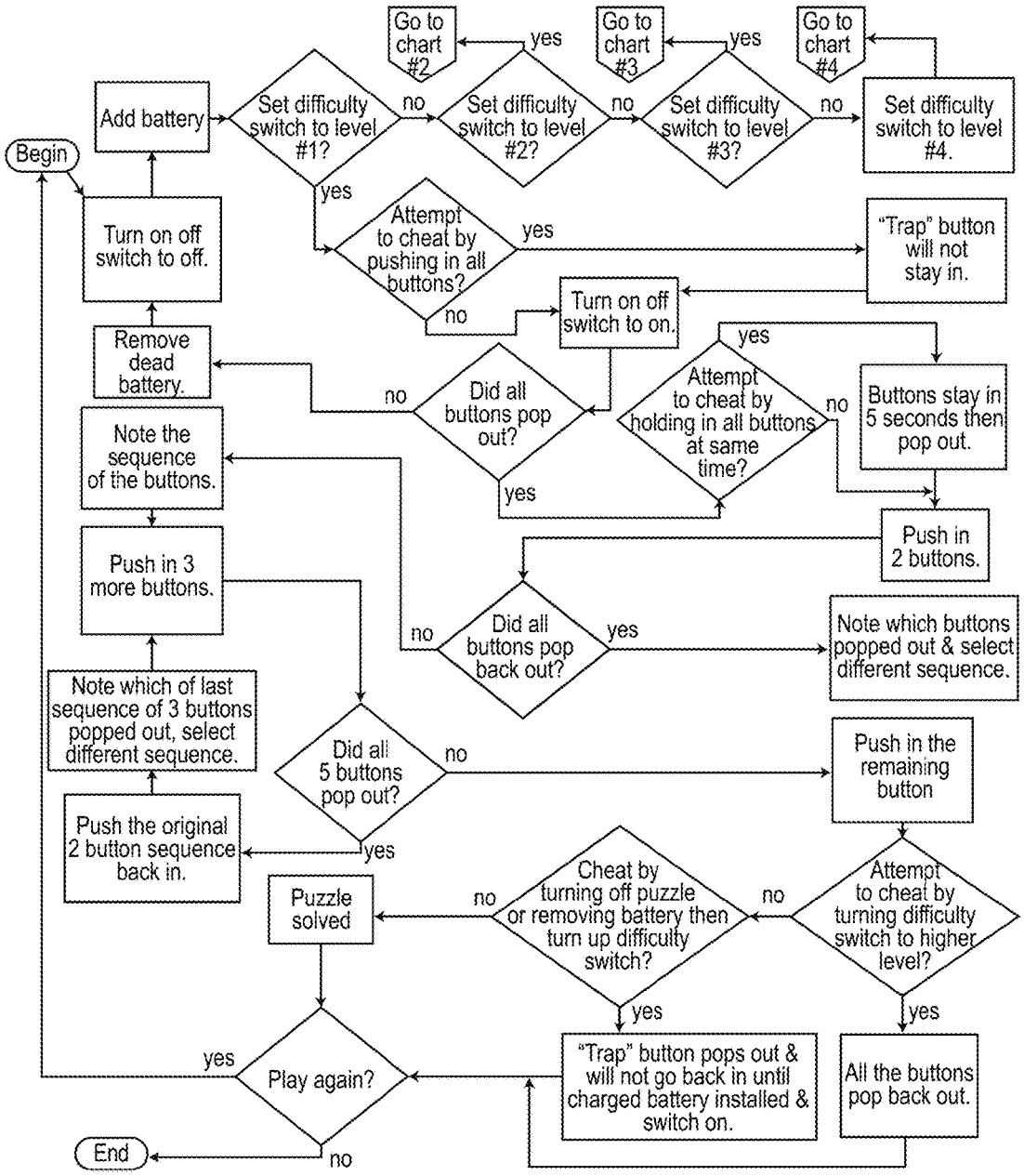
FIGS. 1B-1E are flow charts showing operation of an electromechanical implementation of the preferred cubic embodiment of the present invention.
Figure 1C:
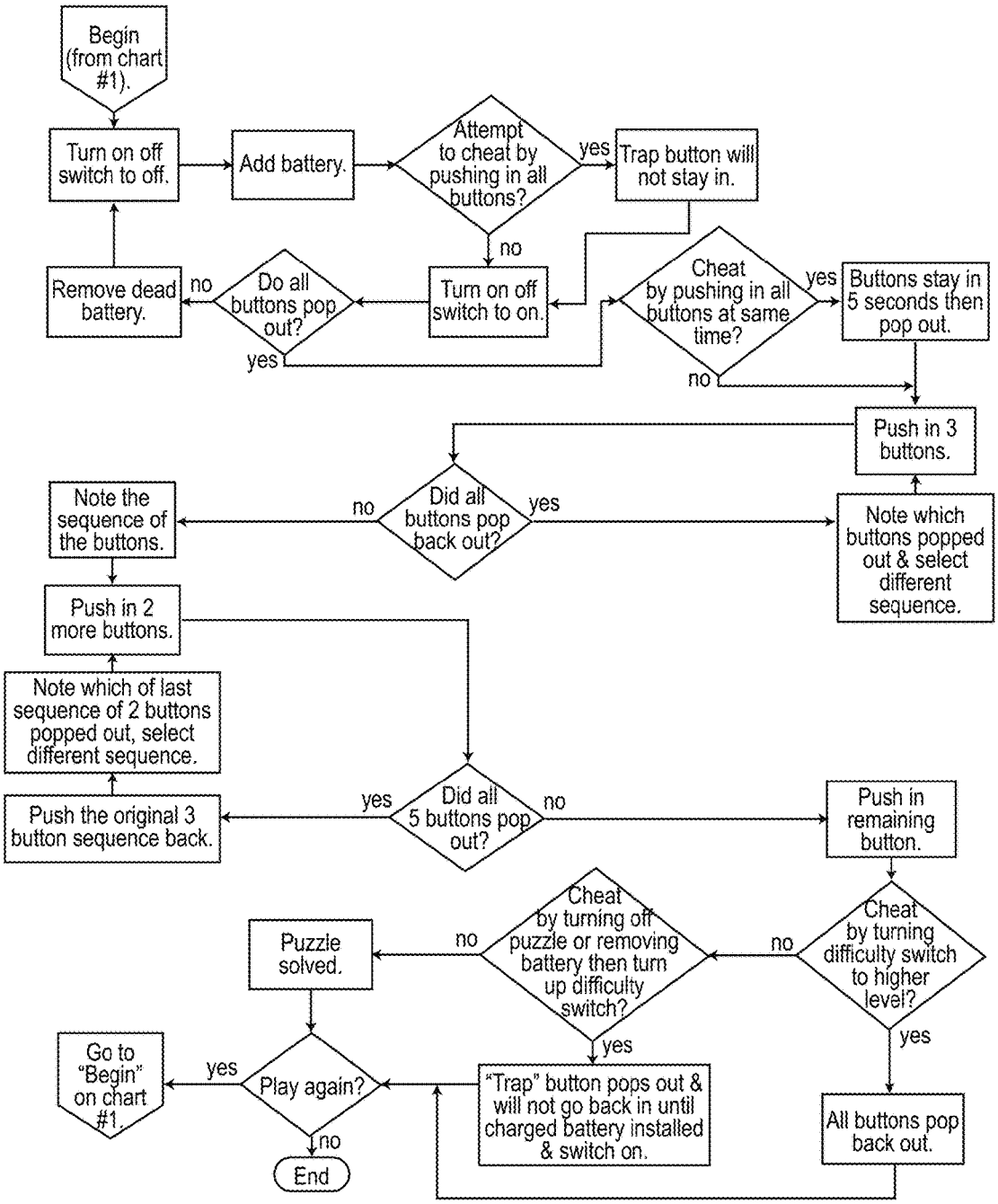
Figure 1D:
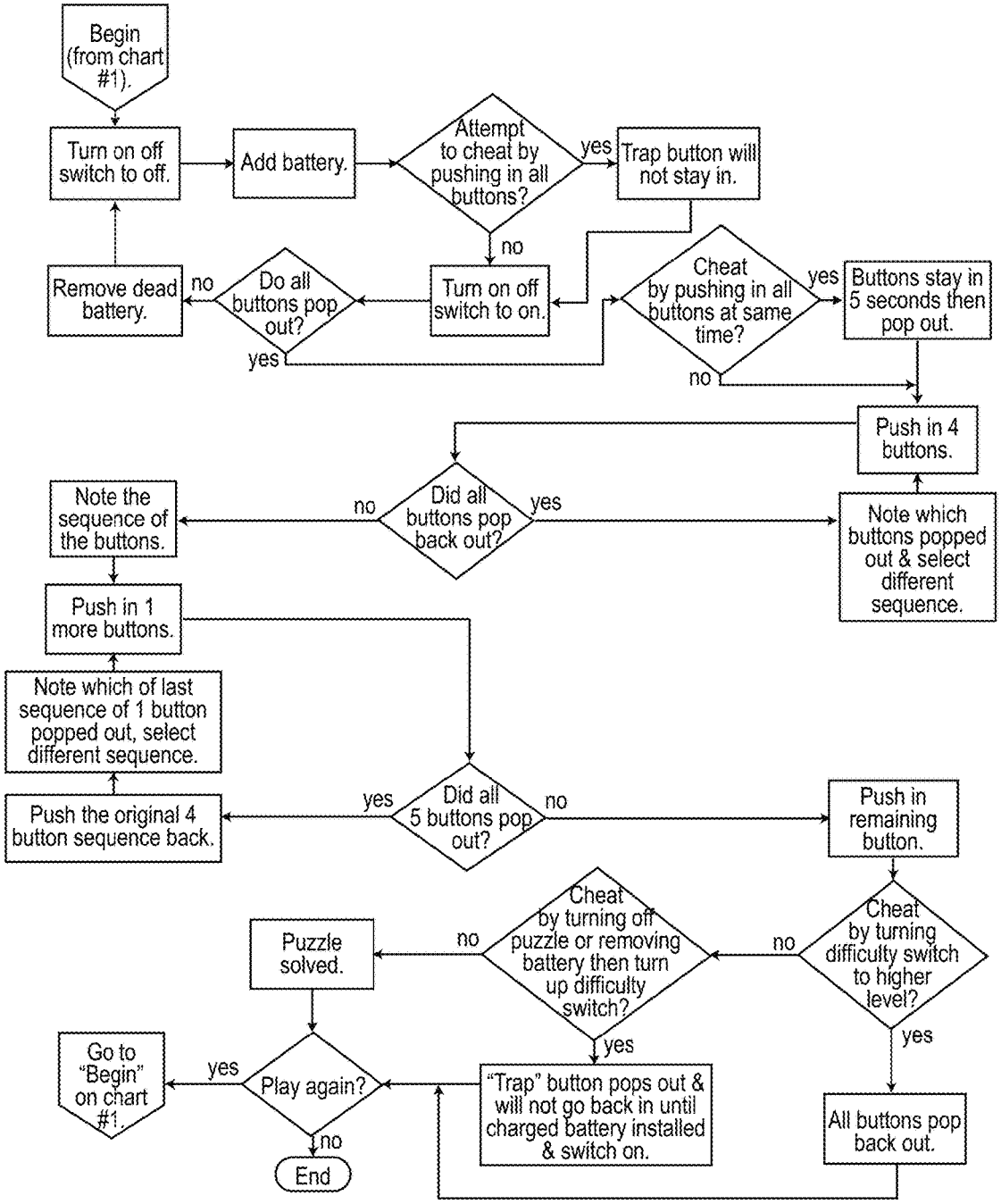
Figure 1E:
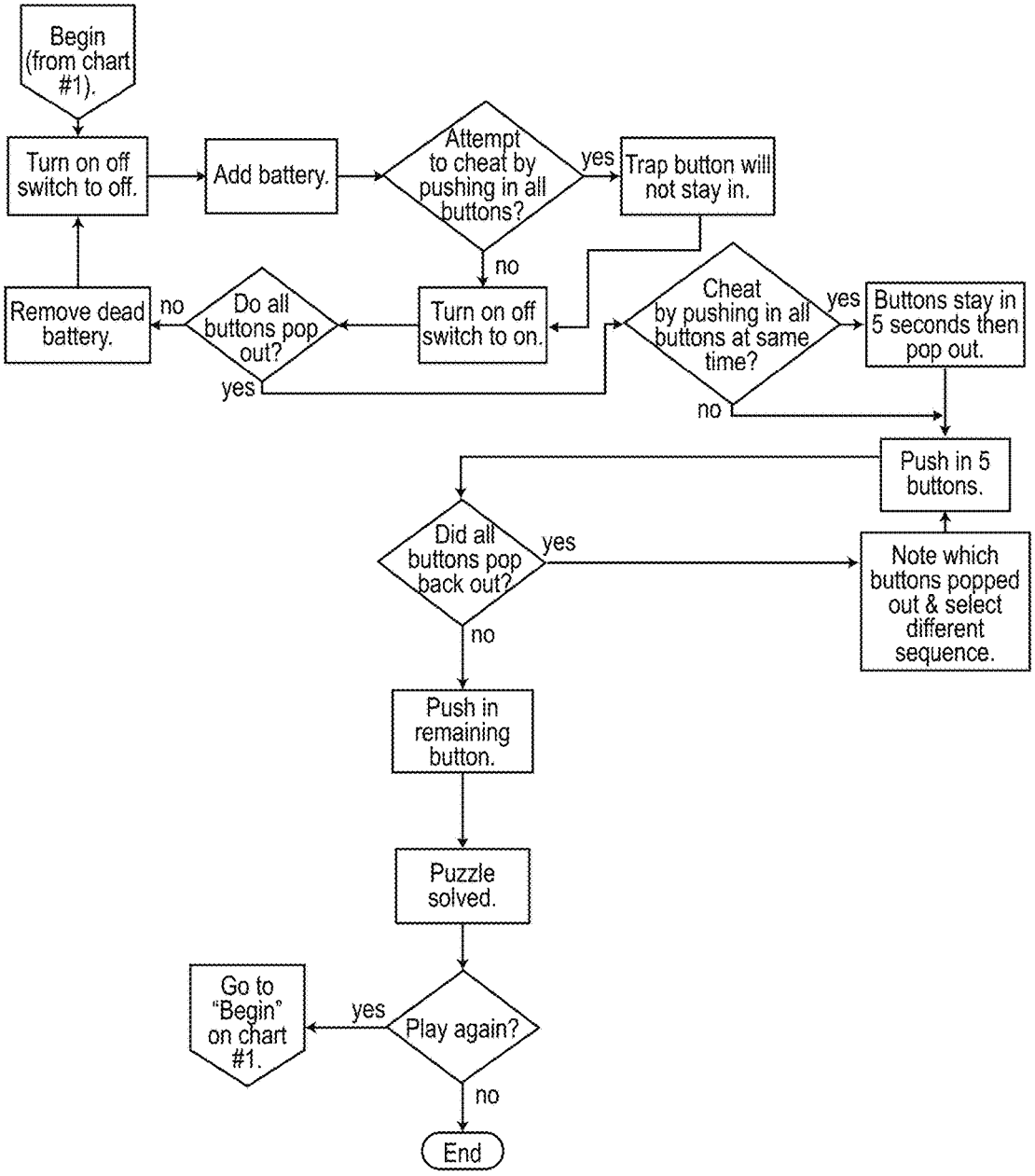
Figure 2B:
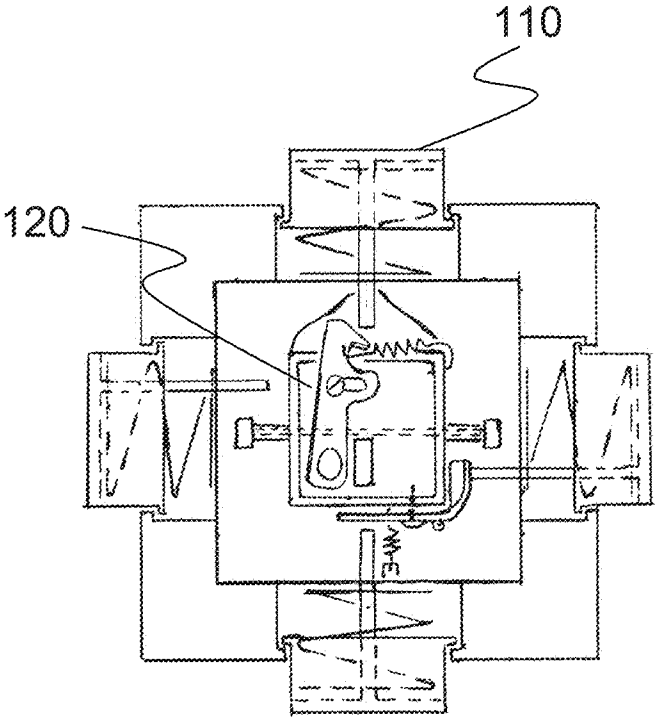
FIG. 2B is a second plan view, oriented at right angles to the plan view shown in FIG. 2*a*, with a portion of the body removed, to show the interior of the invention with a mechanical latching system.
Figure 2A:
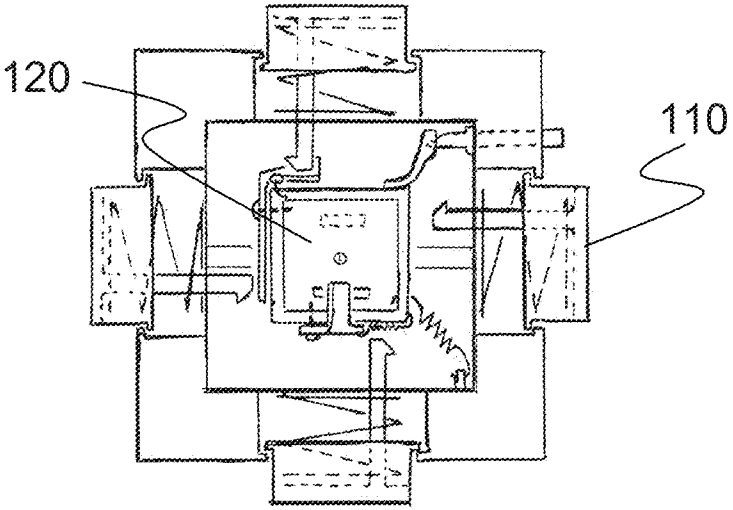
FIG. 2A is a plan view of the embodiment shown in FIG. 1, with a portion of the body removed, to show the interior of the invention with a mechanical latching system.

Referring now to FIG. 1, the preferred embodiment of the button puzzle of the present invention has a cubic shaped body which may be formed of wood or plastic and held together by screws or adhesive. The body of the puzzle in its cubic form has a button on each of the six faces of the cube, labeled A-F. On one face (e.g. on the face having button "A" as shown in FIG. 1) is a reset button 10.

Figure 3A:
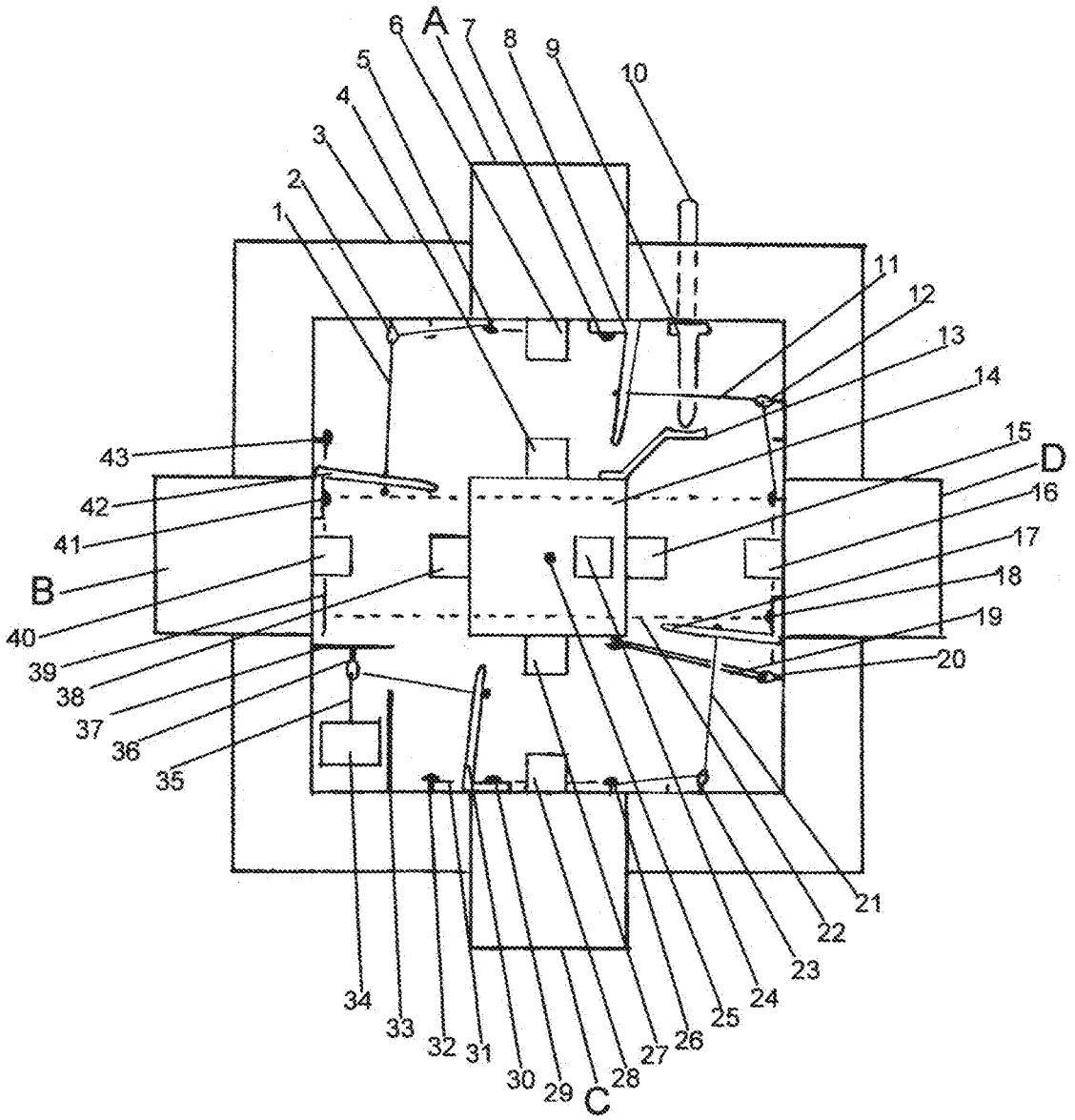
FIG. 3A is a plan view, with a portion of the body removed (button side "E"), to show the interior of the invention with a magnetic latching system.

Referring to FIG. 3A, lead weight 34 is enclosed within housing 33. Weight 34 is attached to string 35. String 35 runs through eye screw 36. Eye screw 36 is screwed into housing top enclosure 37. String 35 is attached to spring like arm 30. Arm 30 is secured to button C with screw 29. Button C has a magnet 28 secured to it with the south pole of magnet 28 facing inward toward center rotor 14. Button C has rubber band 31 running through hole 51 (FIG. 3B) in magnet 28. Rubber band 31 is secured on either side of button C by means of screw 32. Screw 32 stands out above inner surface of body 3 a small bit and an identical screw on opposite side. Rubber band 31 holds button C's inner surface flush with inner surface of body 3. When weight 34 is pointing straight down and inline with gravity it pulls on string 35, which pulls arm 30 from its normal resting position toward weight 34. If button C is pushed inwardly at this time arm 30 will not strike rotor 14. Arm 30 will slide along side of rotor 14. Button C magnet 28, with its south face facing rotor 14, will engage rotor 14 magnet 27 with its north face facing button C. The magnets will lock holding button C's outside surface flush with body 3. If weight 34 is not vertically inline with gravity, spring like arm 30 will pull string 35 and string 35 will pull weight 34, whereby arm 30 will point at the rotor 14 in its start position. If button C is pushed inwardly at this time, arm 30 will engage rotor 14 turning it ⅛th of a revolution. All magnets will disengage and all buttons (if any are in) will pop out. Buttons will be pulled out by their respective rubber bands (which are duplicates of rubber band 31 shown on button C). If button C is successfully engaged so its outer surface is flush with body 3, button C will pull string 21 attached to button C by screw 26. String 21 which runs through eye screw 23 and is attached to spring like arm 17 through hole 62 (FIG. 3*c* 3C) will pull arm 17. Arm 17 which is attached by screw 18 to button D will be pulled clear of rotor 14. If button D is pushed inward at this time arm 17 will slide up along side rotor 14 and magnet 16 with its south face pointing inward will engage and lock together with rotor 14's magnet 15 with its north face pointing outward. If reset button 10, with its integrated bulge 9 (that stops button 10 from sliding out of the close fitting shaft) is pushed while button D and button C are flush with the outer body 3, then reset button 10 will push rigid arm 13. Ridged arm 13 is attached to rotor 14 and will turn rotor 14 ⅛th of a revolution. Rotor 14 spins on axle shaft 25. Axle 25 is mounted in rigid brackets 55 and 22 as shown in FIG. 3C. When rotor 13 is turned by means of reset button 10 all magnets will disengage and buttons D and C will be pulled to their outward positions by means of their respective rubber bands. When reset button 10 is released rotor 14 is pulled back to its starting position by means of rubber band 19. Rubber band 19 is attached to rotor 14 by screw 49 as shown in FIG. 3C. Rubber band 19 is attached to inner surface of body 3 by eye screw 20. Rotor 14 returns to its starting position and no further, being stopped by arm 13, which is stopped by bulge 9 in button 10.

If buttons C and D are successfully pushed inward button D will pull string 11. String 11 is attached to button D by a small screw. String 11 runs through eye screw 12 and attaches to spring like arm 8 through hole 45. Arm 8 is attached to button A by screw 7. String 11 pulls arm 8 clear of rotor 14. If button A is pushed in at this time, arm 8 will slide up the side of rotor 14, and magnet 6 (south face in) will engage magnet 4 (north face out) and lock together. Button A, now flush with outer body 3, pulls string 1 through eye screw 2. String 1 is attached to button A by small screw 5. String 1 pulls spring like arm 42. Arm 42 is attached to button B by screw 41. String 1 pulls arm 42 clear of rotor 14. Now button B is pushed in and arm 42 clears rotor 14. Magnet 40 (south face in) engages magnet 38 (north face out) and locks button B in the inward flush position. When button B pops back out by means of reset button 10 being pushed, rubber band 39 pulls it back to its start position.

Rubber band 39 is secured by screw 43 on one side. Band 39 goes through hole 58 in magnet and is secured to opposite side of button by a screw (duplicate of screw 43). When button B pops out its arm 42 goes back to its start position like all buttons with arms.

Buttons E and F are passive buttons. They are not directly affected by the other buttons. Pushing in button F (when rotor is in start position) magnet 54 (south face in) engages magnet 53 (north face out) and locks with same, albeit with bracket 55 sandwiched in between, which has no effect on the magnetic field if the bracket material is non-magnetic. When the rotor 14 is turned by another button or reset button 10, button F is pulled back to its starting position by rubber band 56 attached by screws 57 and 52. Button E works the same as button F. The mechanics have been explained.

Figure 3B:
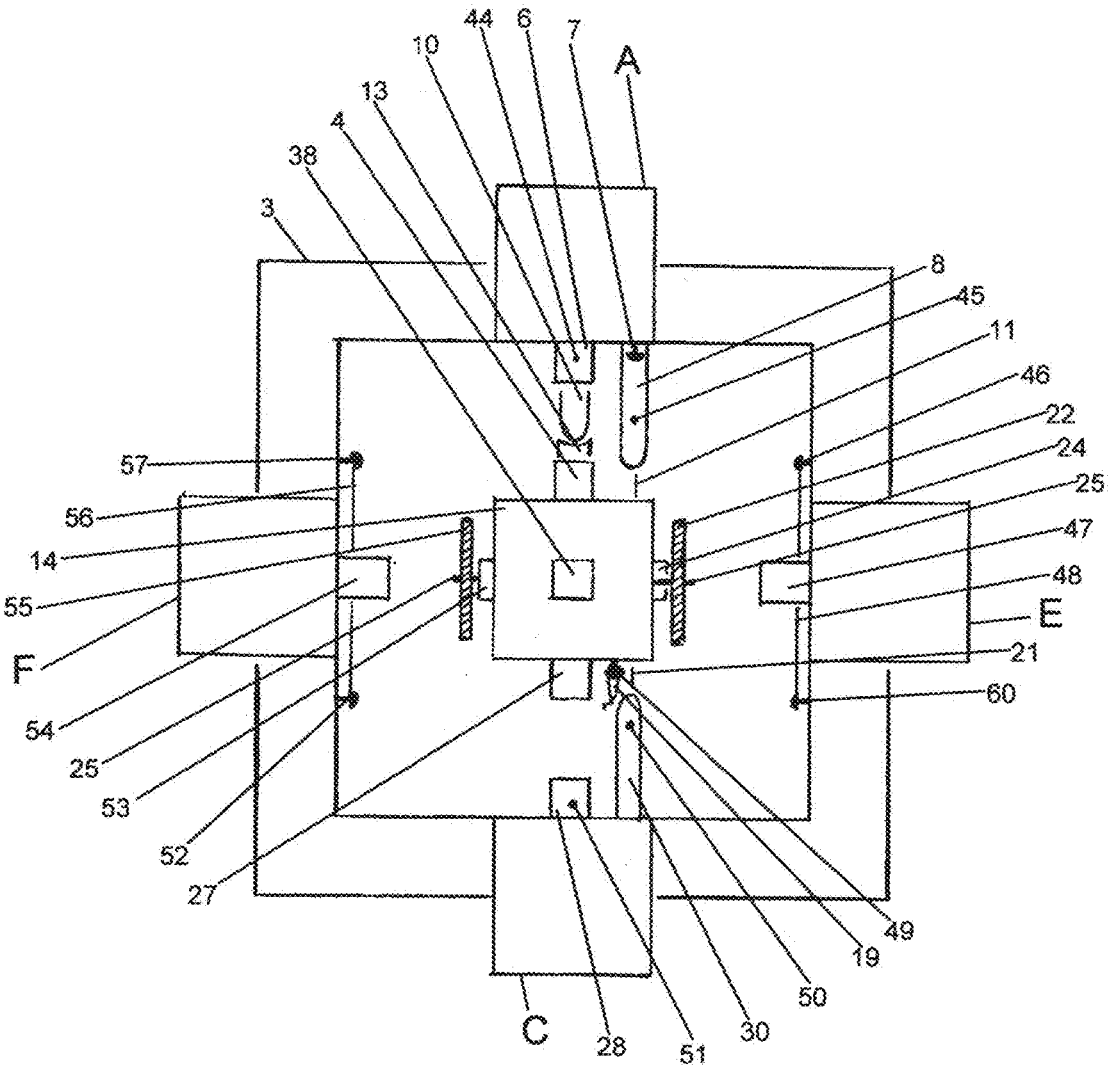
FIG. 3B is a plan view, with a portion of the body removed (button side "B"), to show the interior of the invention with a magnetic latching system.
Figure 3C:
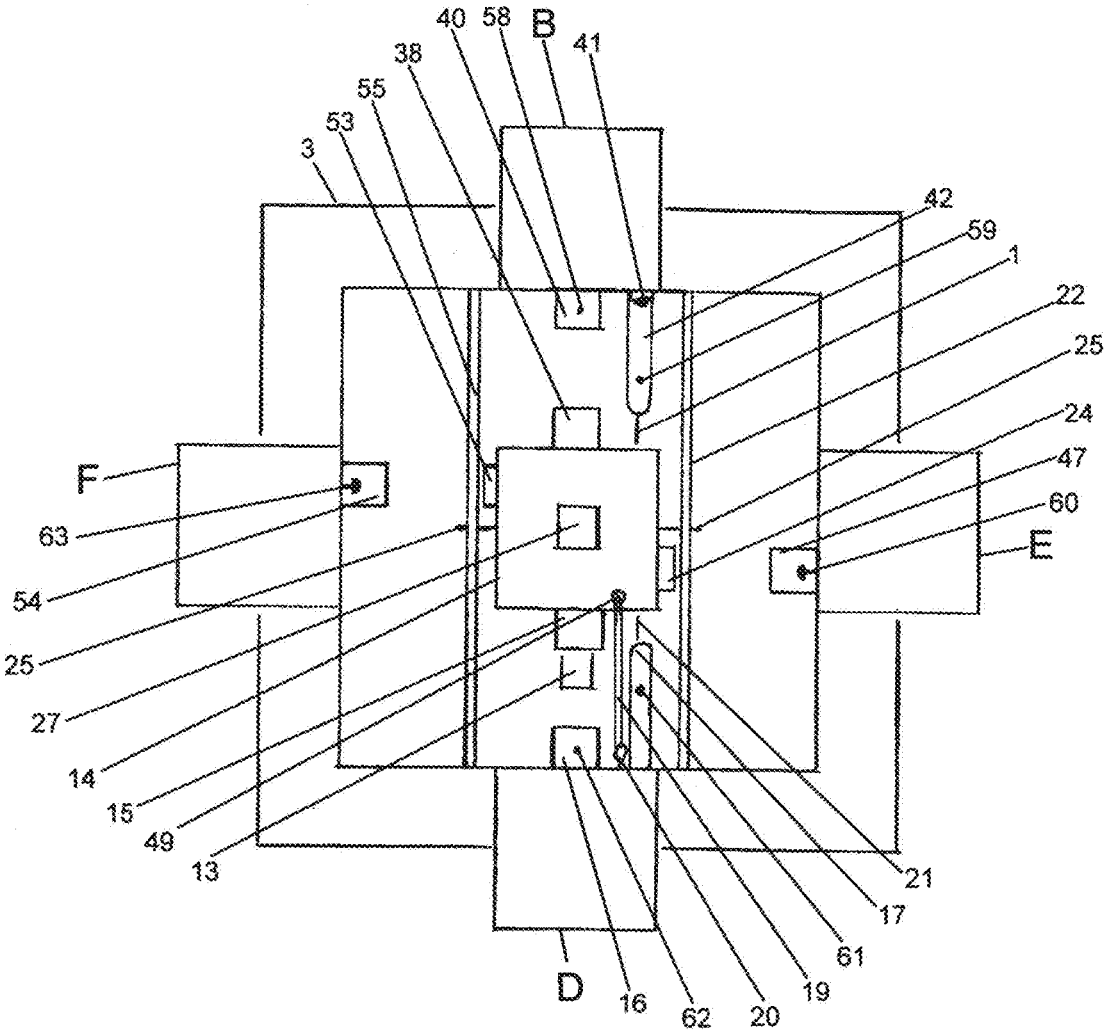
FIG. 3C is a plan view, with a portion of the body removed (button side "C"), to show the interior of the invention with a magnetic latching system.
Figure 5:
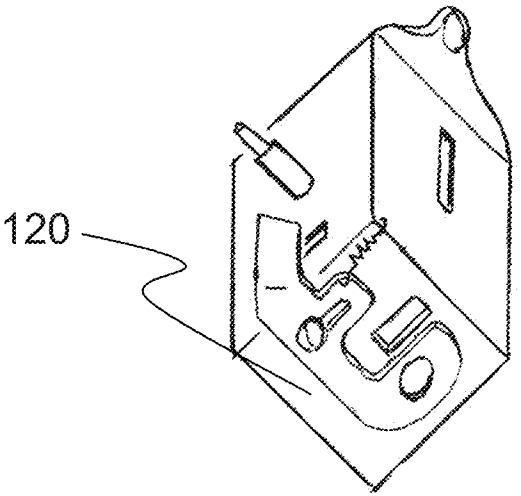
FIG. 5 is a perspective view of the internal mechanism (without supports) of the mechanical latching implementation of the cubic embodiment shown in FIG. 1.
Figure 4:
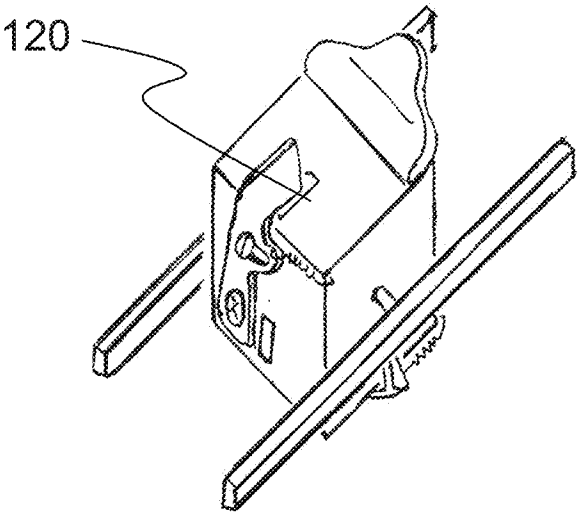
FIG. 4 is a perspective view of the internal mechanism of the mechanical latching implementation of the FIG. 1 embodiment.
Figure 7:
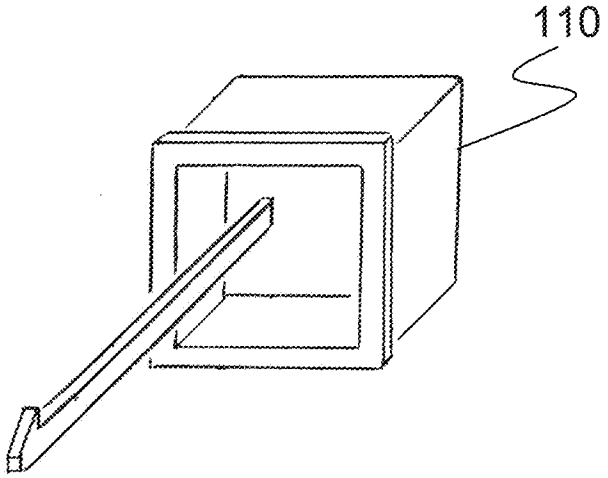
FIG. 7 is a perspective view of one of the two (parallel to central axle) buttons of the mechanical latching implementation with its attached hook.
Figure 6:
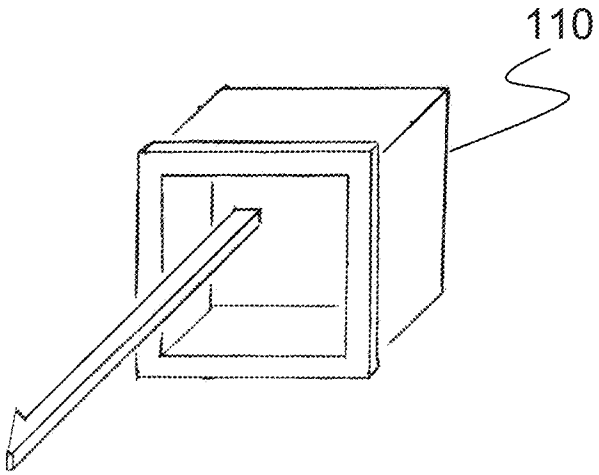
FIG. 6 is a perspective view of one of the four (perpendicular to central axle) buttons of the mechanical latching implementation with its attached hook.
Figure 9:
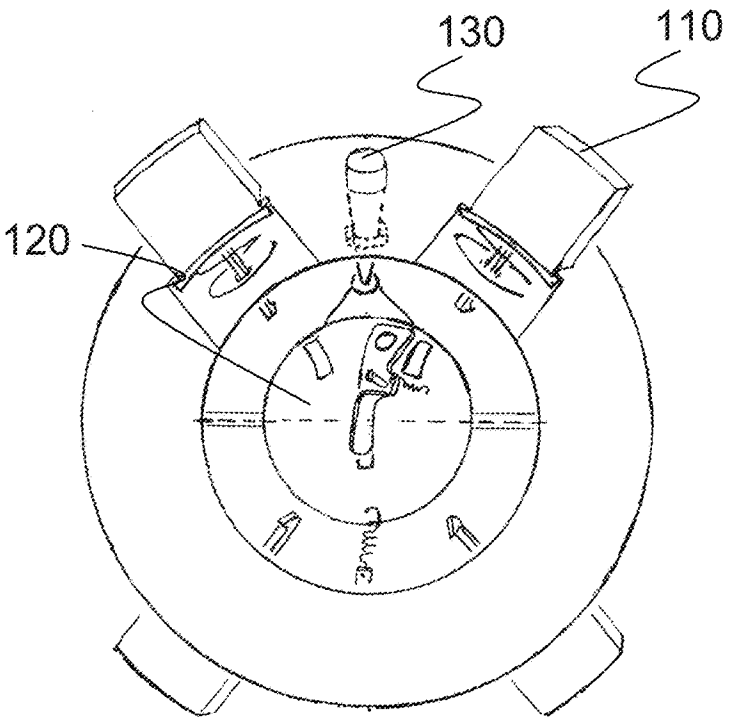
FIG. 9 is a perspective view of a spherical version of the mechanical latching implementation of the present invention with a portion of the body removed to show the interior thereof.
Figure 8:
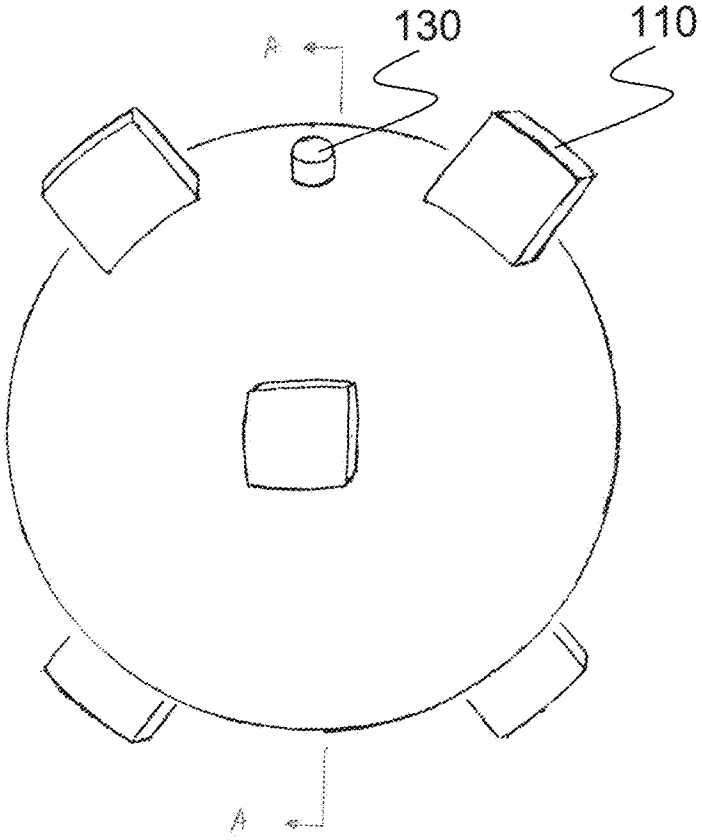
FIG. 8 is a perspective view of a spherical version of the first, preferred embodiment of the present invention.
Figure 11:
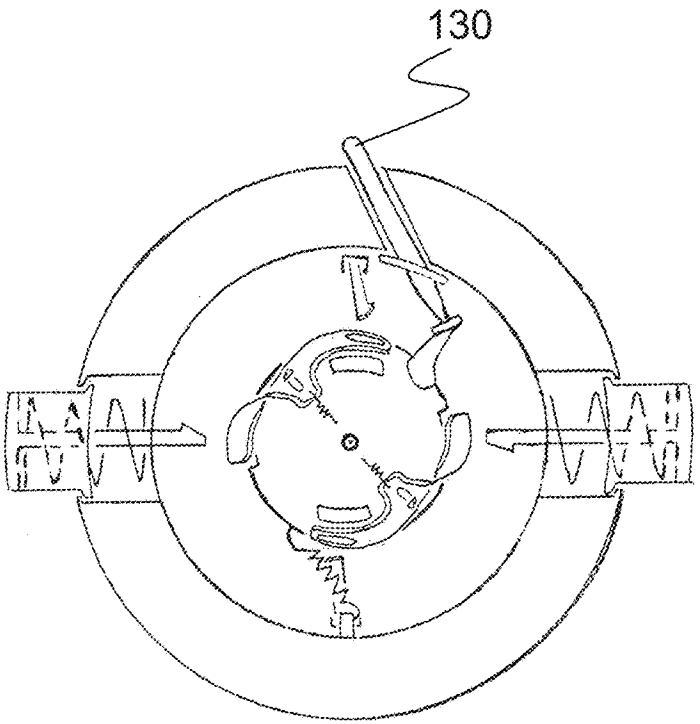
FIG. 11 is a plan view of a spherical version of the mechanical latching implementation of the present invention taken along line A-A of FIG. 8 with a portion of the body removed to show the interior thereof.
Figure 10:
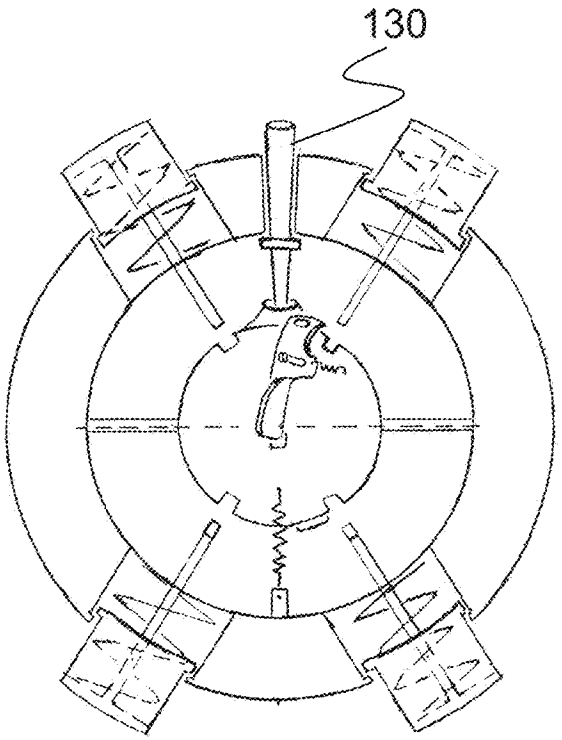
FIG. 10 is a second plan view of a spherical version of the mechanical latching implementation of the present invention with a portion of the body removed to show the interior thereof.

The following are the numbers and the parts they represent, starting at FIG. 3B button A and going clockwise: 8=spring like arm; 45=hole for string; 11=string for arm 8; 46=screw to hold band; 22=axle holding bracket; 24=rotor magnet for button E; 25=axle; 47=button E magnet; 48=button E band; 21=string for arm 30; 60=band screw; 49=screw to hold the rotors band; 19=rotor return band; 50=hole for string; 30=spring like arm; 51=hole for band; 28=magnet; 27=rotor magnet for button C; 52=band screw; 53=rotor magnet for button F; 25=axle; 54=magnet; 55=bracket; 14=rotor; 56=band; 57=band screw; 3=body; 38=rotor magnet for button B; 4=rotor magnet for button A; 13=rotor arm; 10=reset button; 44=hole for band; 6=magnet for button A; 7=screw for spring like arm;

The following are the numbers and parts they represent for FIG. 3C, starting at button F and going clockwise: 3=body of button puzzle; 53=rotor magnet for button F; 55=bracket; 38=rotor magnet for button B; 40=magnet button B; 58=hole for band; 41=screw for arm; 42=spring like arm; 59=hole for string; 1=string for arm; 22=bracket; 25=axle; 24=rotor magnet for button E; 47=magnet button E; 60=hole for band; 21=string for arm 17; 17=spring like arm; 61=hole for string; 19=rotor band; 20=eye screw for rotor band; 62=hole for band; 16=magnet button D;

13=rotor arm; 49=screw to hold rotor band; 15=rotor magnet for button D; 14=rotor; 27=rotor magnet for button C 25=axle 54=magnet for button F; 63=hole for band.

The foregoing description details apply to the magnetic latching implementation. In the mechanical latching implementation the push buttons 110 (e.g. as shown in FIGS. 2A, 2B, 6 and 7) have a hooklike protrusion which operates the interior latching mechanism 120 (e.g. as shown in FIGS. 2A, 2B, 4 and 5). Reset button 130 has an effect similar to reset button 10 as described above.

Figure 12A:
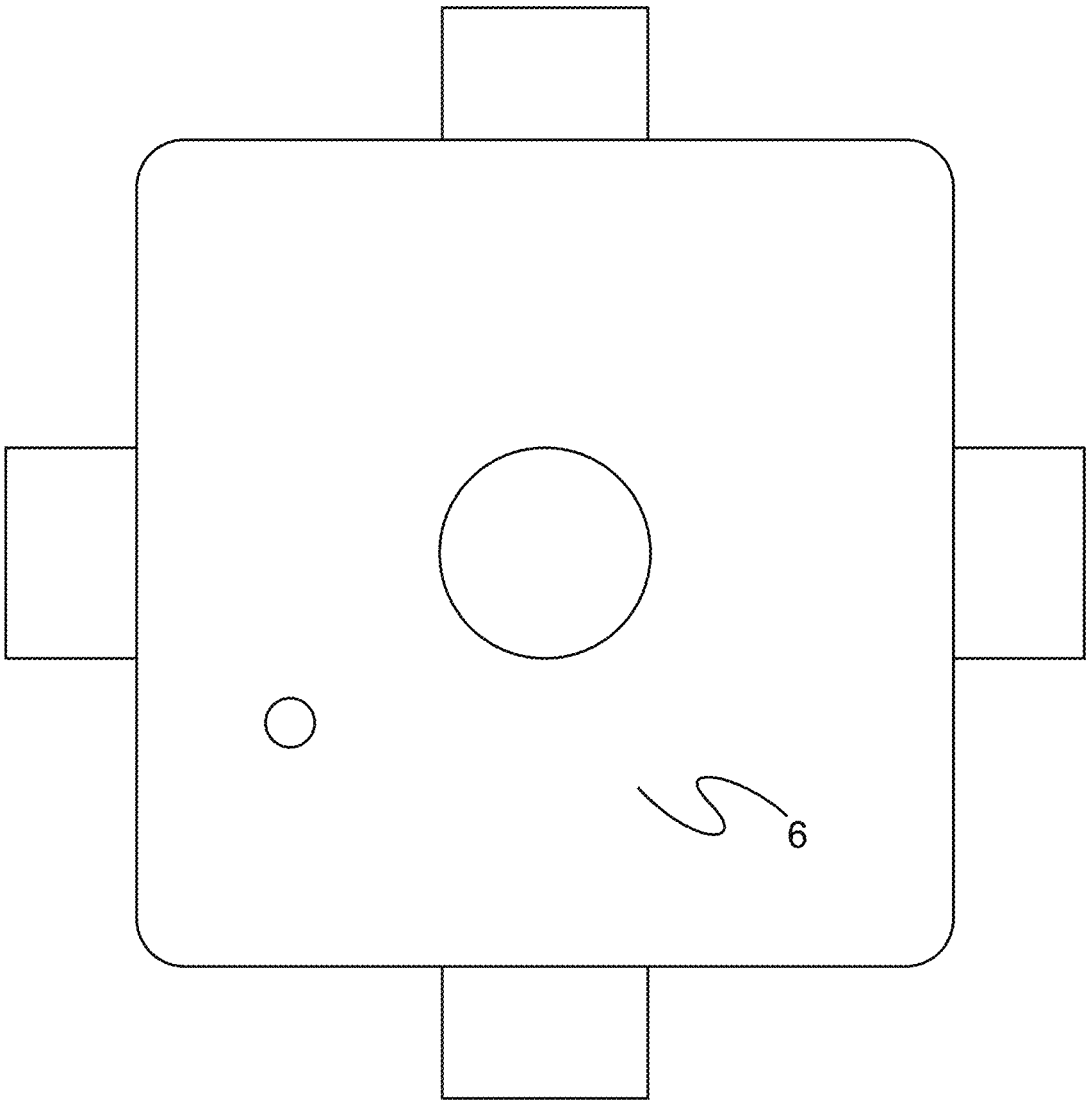
FIG. 12A is an outside view of a preferred cubic embodiment of the invention, looking down on reset button side.
Figure 12B:
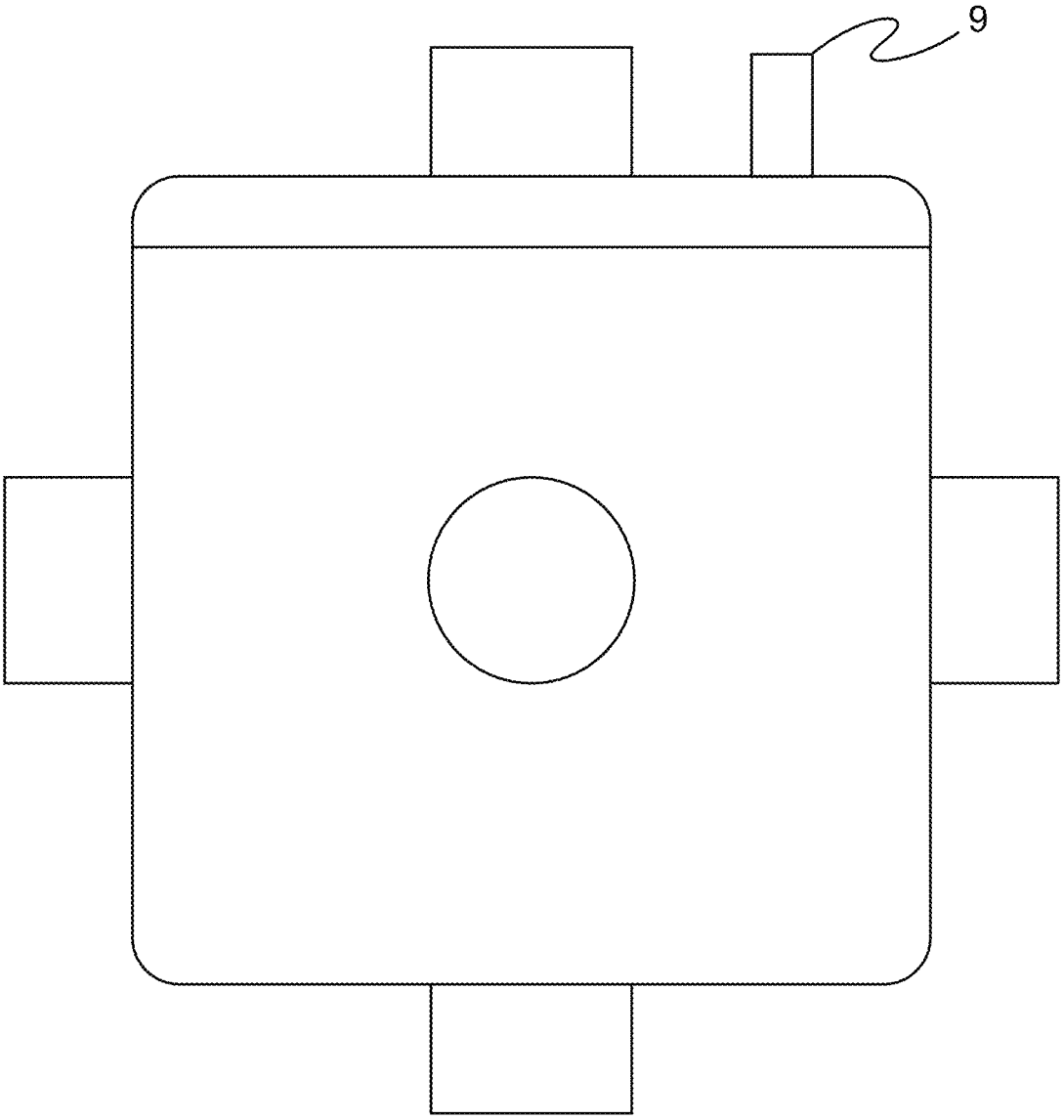
FIG. 12B is an outside view of a preferred cubic embodiment of the invention, with reset button side on the top face (not shown, except reset button pointing up).
Figure 13:
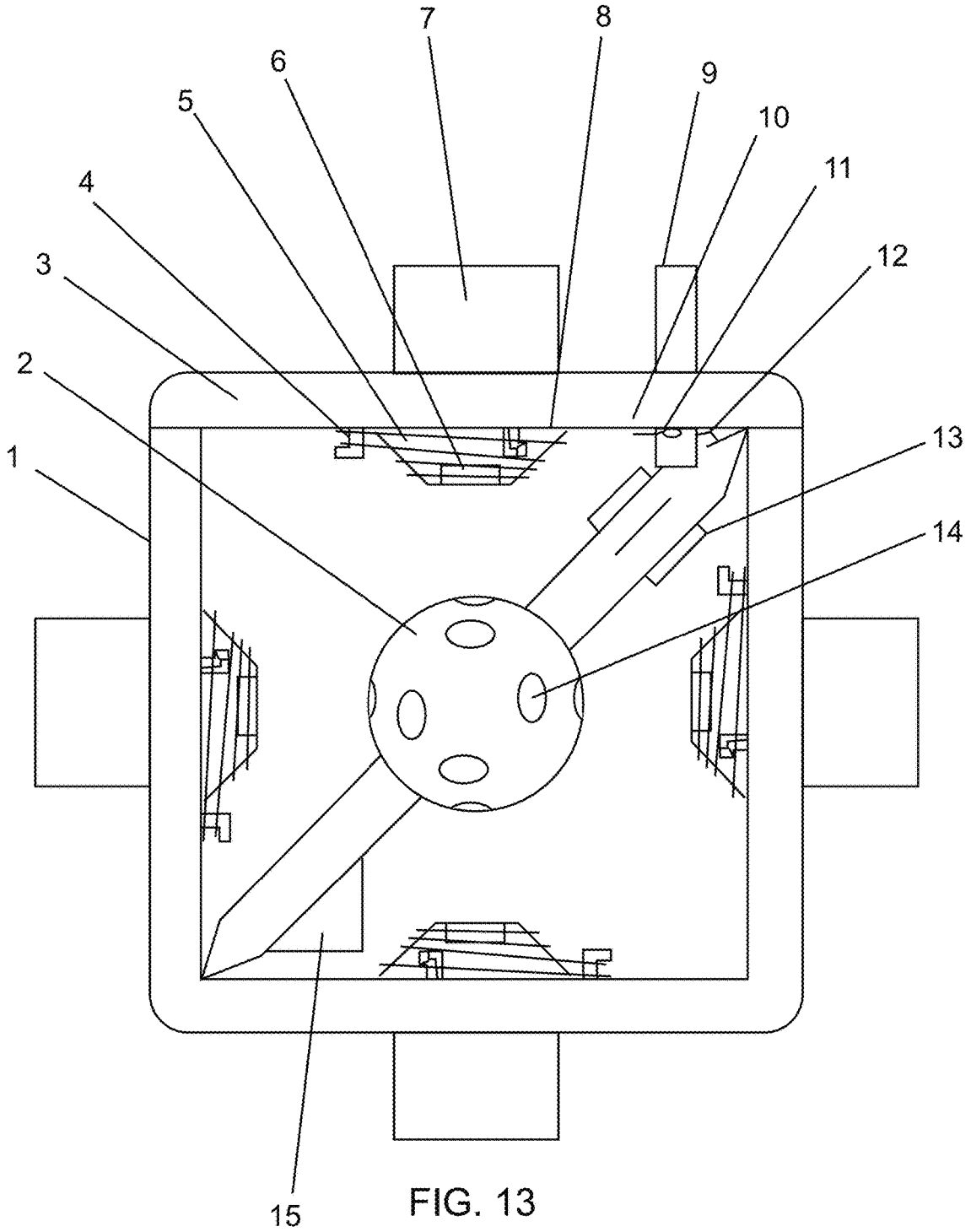
FIG. 13 is a plan view, with a portion of the body removed, reset button side pointing up, to show the interior of the invention with a magnetic latching system.

A further and improved variation of the invention is shown in FIGS. 12A, 12B and 13. This is a variation on the cubic form of the invention, where there is one button on each of the six sides of the cube, plus a small reset button on one side.

Turning now to FIG. 13, body 1 consists of 5 sides and is capped by cap 3 which has button 7 held by spring 5 in the outward starting position. Spring 5 is held in place by spring clip 4. There are three evenly spaced spring clips 4 around button 7. All six buttons are configured the same at button 7, spring 5, and spring clips 4. Magnet 6 resides in the inward end of button 7 and is set flush. Magnet 6 can be south pole facing inward or north pole facing inward, depending upon the degree of difficulty, specific configuration, and costs. Magnet 6 may not be a magnet at all but a magnetic metal such as iron. Overlap 8 keeps button 7 from coming out of the cap 3 or, in the case of the other buttons 7, body 1. Reset button 9 goes through cap 3 and is held in place by elastic band 11, through a small hole in the reset button 9. Elastic band 11 is held in place by hooks 10 and 12. Fins 13 are three in number and extend from rotor 2. When magnetic latching occurs, when buttons 7 are pushed in and the player wishes to unlatch them, the reset button 9 is pushed in to engage fins 13, turning rotor 2 unlatching magnets causing all buttons 7 pushed in to pop out, by force of spring 5. The magnets or magnetic type metal 14 are configured around rotor 2, a sphere on a shaft, in such a way as to cause fins 13 to be in correct alignment with reset button 9, so player can reset game no matter the number of buttons 7 latched.

Reset button 9 will always return to its resting position by action of elastic band 11. Magnets or magnetic type metal 14 are set out around rotor 2. In two rows, each row consists of six magnets or magnetic metal 14 in two rows. Each row consists of six magnets or magnetic metal 14, evenly spaced around the rotor 2. Each row is approximately 60° from their respective pole, and approximately 30° from the equator, so as to line up with certain buttons in their hemisphere, as they rotate while the game is being played. Magnets or the magnetic metal 14 can be set in many different orders in order to make the game harder or easier or cost effective. Lead or steel or other heavy material 15 is attached to rotor 2 to make the game have a set combination, in conjunction with magnets or magnetic metal 14 and 6. Fins 13 are set 15° to right of magnet or magnetic metal 14 centers, as you look down shaft of rotor 2 from fin side 13. Lead or steel or heavy material 15 is centered between magnets or magnetic metal 14, as you look down shaft of rotor 2 from lead or steel or heavy material side.

Figure 14:
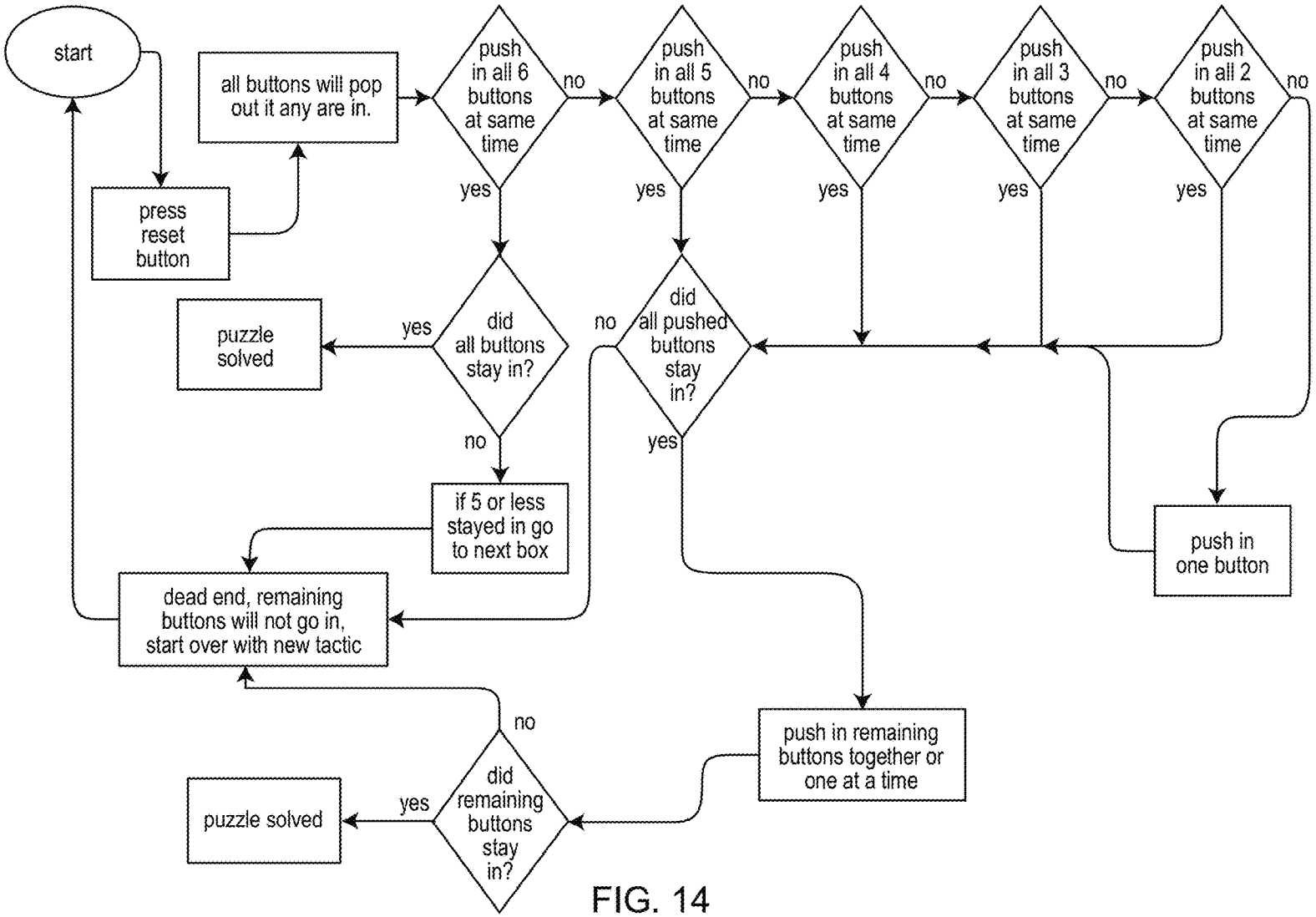
FIG. 14 is a flow chart showing operation of the preferred cubic embodiment.

FIG. 14 is a flow diagram showing operation of the preferred cubic embodiment of the invention.

Figure 15A:
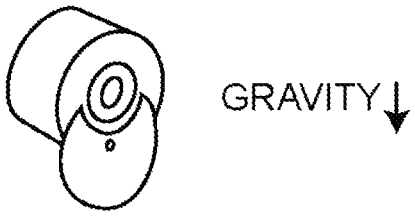
FIGS. 15A, 15B and 15C show a perspective view, a front view, and a side view, respectively, of a shielding device for making the puzzle harder to solve.
Figure 15B:
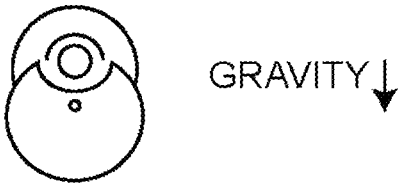
Figure 15C:
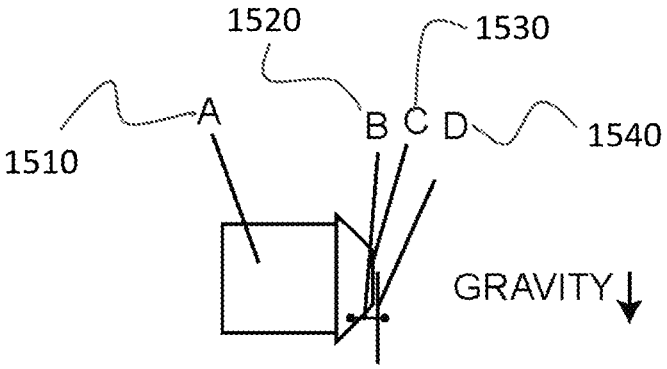

A further aspect of the invention is a gravity dependent shielding device which can be added to any button to make the puzzle harder to solved. FIG. 15A is a perspective view of a single button with the shielding device attached. FIG. 15B is a plan view of the side of the button with the shielding device attached. Button 1510 (item "A") as it turns within the body of the button puzzle (as a player tries to solve the puzzle), allows shield 1540 (item "D") to rotate on axle 1520 (item "B"). The heaviest side of shield 1540 (item "D") will always point downward with gravity. Depending upon the orientation of button 1510 (item "A"), shield 1540 (item "D") will either uncover magnet 1530 (item "C") allowing magnet 1530 (item "C") to latch or cover magnet 1530 (item "C") keeping it from latching. Shield 1540 (item "D") can be made of aluminum, plastic or any other suitable non-magnetic material. Axel 1520 (item "B") is attached to button 1510 (item "A"). This shielding device can be attached to one or more buttons.

Figure 16A:
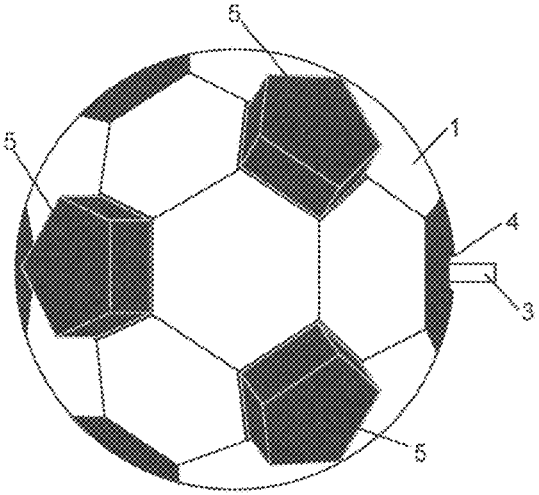
FIG. 16A is an outside view of spherical (soccer ball) version showing half of the sphere.
Figure 16B:
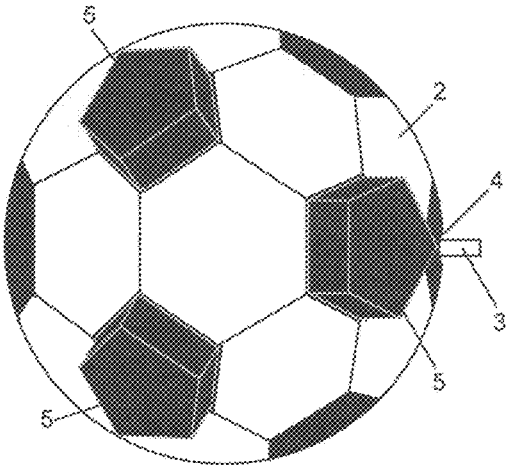
FIG. 16B is an outside view of spherical (soccer ball) version and shows half of the sphere, opposite side of FIG. 16A.

Another improvement of the invention is shown in FIGS. 16A and 16B. This is the complete spherical (soccer ball) form of the invention. It shows both sides of the traditional soccer ball, in 3" diameter form. It has six identical buttons number 5, (although it can have up to ten buttons in this form). The buttons number 5 are the pentagons spaced as shown. FIG. 16A shows outside, half shell 1. FIG. 16B shows outside, half shell 2. FIG. 16A and FIG. 16B show buttons 5 and reset button 3 and reset button opening 4.

Figure 17:
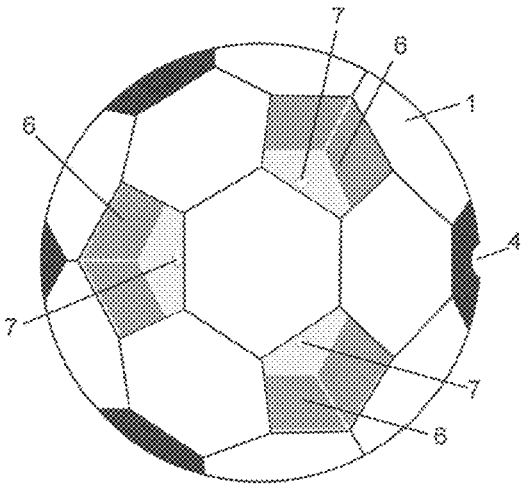
FIG. 17 is an outside view of spherical version showing FIG. 16A with buttons removed revealing button housings and shaft holes.
Figure 18:
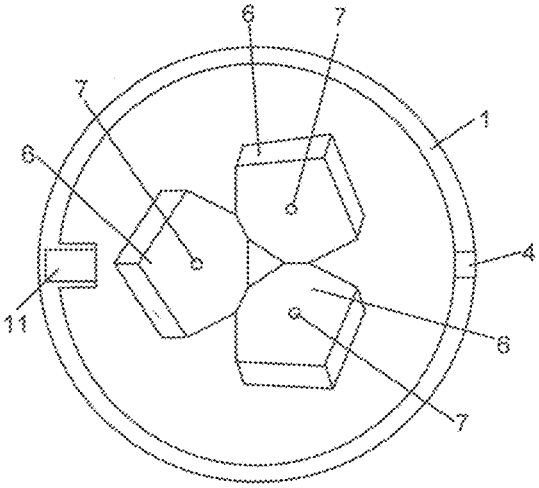
FIG. 18 is an inside view of FIG. 17 showing button housings, spring housing and shaft holes.

FIG. 17 is the outside half shell 1 with the number 5 buttons and reset button 3 removed. Also showing reset button opening 4 and button housings 6 and shaft holes 7. FIG. 18 shows the inside of half shell 1 and showing button housings 6 and shaft holes 7, also reset button opening 4 and reset spring housing 11.

FIGS. 19, 19A, 19B, 19C, 19D, 20, 21 and 22 will explain three improvements. Two rotors instead of one to make the puzzle more difficult. A new weight system to vary the combination to make the puzzle more difficult. A new simplified reset system.

FIG. 19 (enlarged to see detail) shows the inside of half shell 1 with two rotor assembly installed. The two rotors 15 and 21 spin independently on axle 13 making puzzle more difficult to solve. The rotor assembly is made up of reset button 3 (in reset opening 4). There is a 0.0625" steel axle 13 starting and residing in 0.125" deep×0.0675" diameter hole 14. Hole 14 is centered in reset button 3, and FIG. 19A shows bottom of reset button 3 and hole 14.

Returning to FIG. 19, axle 13 continues through rotor half 15 through 0.0675" diameter hole 16. Hole 16 runs through and is centered in rotor half 15. FIG. 19B shows the small end of rotor 15 and hole 16. Rotor half 15 has two rings 17 and 18 that are 0.0625" proud (i.e. "standing out") of outer shaft of rotor half 15 and serve to corral plastic band 19. Steel weight 20 is attached to plastic band 19. The inner diameter of band 19 is larger than the outer diameter of rotor 15 where band 19 resides. FIG. 19C shows small end of rotor 15 cut away just beyond ring 17, to reveal band 19, rotor shaft 15, hole 16, weight 20. Back to FIG. 19, this results in band 19 along with its attached weight 20 arbitrarily releasing and spinning rotor 15 to change the combination of solving the puzzle as the puzzle is moved about by the user. This makes the puzzle more difficult to solve as opposed to the fixed weight rotor which is easier to solve. The fixed weight rotor always has the same combination. But understand both the fixed weight rotor and this new innovation semi-free spinning weight (band 19, weight 20) on the shaft of rotor half 15 can still be solved with logic and memory and is not random.

Continuing with FIG. 19, rotor half 21 with ring 22, band 23, weight 24, ring 25 are identical to rotor half 15, ring 18, band 19, weight 20, ring 17. Rotor half 21 spins on axle 13. The end of axle 13 resides in slider 26 in hole 27. FIG. 19D shows inside facing view of slider 26 with 0.125" deep× 0.0675" diameter hole 27 centered in slider 26. Returning to FIG. 19, spring 28 (in reset spring housing 11) pushes against slider 26, which pushes against axle 13, which in turn pushes against reset button 3. Flange at the bottom of reset button 3 keeps it inside half shell 1 and half shell 2 when both shells are joined together to form the puzzle toy. The tension of spring 28 serves to keep axle 13, rotors 15 and 21 centered in soccer ball (half shell 1 and half shell 2).

The new reset system unlatches any buttons in the "pushed in position". To understand, FIG. 20 shows button 5 with attached shaft 8, magnet 9 is attached to shaft 8, spring 10 surrounds shaft 8.

FIG. 21 shows a cutaway view of button 5 in its starting position, and its spatial relationship to rotor 15 and 21 inside soccer ball (half shell 1 and half shell 2). FIG. 21 also shows button 5 in housing 6. Housing 6 is a part of half shell 1. Shaft 8 is attached to button 5, spring 10 encircles shaft 8 and keeps button 5 in the outward starting position. Shaft 8 is 0.0625" in diameter and goes through hole 7 which is 0.0675" in diameter, magnet 9 which is attached to shaft 8 keeps button 5 from completely coming out of housing 6. FIG. 22 shows the "pushed in" position of button 5. Magnet 9 magnetically holds on to magnet 12 holding button 5 in. Back to FIG. 19 when the user pushes reset button 3 in, button 3 pushes axle 13 and rotor 15 and rotor 21 and slider 26 towards spring 28. When rotor 15 and 21 move in this manner so do all the magnets 12 that are attached to rotor 15 and 21. A user pushing in of a button out of the predetermined order causes the rotor to rotate about an axis, thereby resetting any latched buttons. Back to FIG. 22 when rotor 15 and its magnets 12 move with it magnetic hold is lost between magnet 9 and magnet 12. Spring 10 under tension can now push button 5 back to starting position as in FIG. 21. Note that the magnets 12 are illustrated in FIG. 19 for convenience, and are arranged on rotor 15 and 21 in a spherical symmetry such that the push button shafts 8 are aligned in the direction of the spatial center of the toy and when button 5 is depressed magnet 9 intersects the rotor at magnet 12.

Back to FIG. 19, when a user releases reset button 3 spring 28 under tension pushes slider 26, axle 13, rotor 21, rotor 15 and reset button 3 and all their associated magnets, bands and weights back to their starting position.

Having thus described my invention, what I claim as new and desire to secure by Letters Patent is as follows:

1. In a puzzle solution method comprising presenting to a user a plurality of push buttons arrayed on the outer surface of a toy, providing a latching mechanism within said toy that latches each of said plurality of push buttons in a pushed-in position provided each of a selected subset of said plurality of push buttons is pushed by the user in a predetermined order, providing a reset mechanism for unlatching any latched push buttons when one of said selected subset of push buttons is pushed-in out of said predetermined order, and providing a chance mechanism that changes the predetermined order upon the occurrence of an event unknown to the user, said event relating to user operation of said toy, an improvement comprising:

using a rotor at a spatial center of the toy for said latching mechanism, said rotor thereby being a latching rotor; and providing a shaft around which the latching rotor rotates, the shaft being partitioned in two segments along a common axis, with the latching rotor being separated into two portions along a plane running perpendicular to the shaft axis, each latching rotor portion rotating independently of the other with a respective shaft segment.

2. The puzzle method of claim 1, wherein said separating plane runs through a center of the latching rotor so that the two rotor portions are mirror images of one another.

3. The puzzle method of claim 1, wherein the event unknown to the user is user orientation of the toy in a particular direction, and wherein the outer surface of said toy is shaped symmetrically with respect to the spatial center of said toy.

4. The puzzle method of claim 3, wherein the latching rotor has magnets of one polarity in the direction of each push button, there being a magnet of the opposite polarity on the inner side of each said button.

5. The puzzle method of claim 3, further comprising attaching a weight to one respective shaft segment, wherein said user orientation of the toy causes the weight to rotate the respective latching rotor portion.

6. The puzzle method of claim 4, wherein user pushing in of a push button out of the predetermined order causes the latching rotor to rotate about an axis, thereby resetting any latched buttons.

7. The puzzle method of claim 5, further comprising attaching a weight to a second respective shaft segment, wherein said user orientation of the toy causes the weight to rotate the respective latching rotor portion.

8. The puzzle method of claim 7, further comprising moving the shaft along its axis to implement said reset mechanism, said movement causing the latching rotor to move off center thereby decoupling the magnetic connection between each pushed-in push button and the latching rotor.

9. The puzzle method of claim 8, wherein said movement along the shaft axis is initiated by pressing a reset button aligned along the axis of the shaft, said movement being operable to unlatch any latched push buttons without changing said predetermined order.

10. The puzzle method of claim 7, wherein the outer surface of the toy is a sphere and each of six push buttons is symmetrically spaced on the surface of the sphere, there being in addition a reset button located on the surface of the sphere.

11. In a puzzle apparatus comprising a plurality of push buttons arrayed on the outer surface of a toy, a latching mechanism within said toy that latches each of said plurality of push buttons in a pushed-in position provided each of a selected subset of said plurality of push buttons is pushed by a user in a predetermined order, a reset mechanism for unlatching any latched push buttons when one of said selected subset of push buttons is pushed-in out of said predetermined order, and a chance mechanism that changes the predetermined order upon the occurrence of an event unknown to the user, said event relating to user operation of said toy, an improvement comprising:

a rotor at a spatial center of the toy for said latching mechanism, said rotor thereby being a latching rotor; and a shaft around which the latching rotor rotates, the shaft being partitioned in two segments along a common axis, with the latching rotor being separated into two portions along a plane running perpendicular to the shaft axis, each latching rotor portion rotating independently of the other with a respective shaft segment.

12. The puzzle apparatus of claim 11, wherein said separating plane runs through a center of the latching rotor so that the two rotor portions are mirror images of one another.

13. The puzzle apparatus of claim 11, wherein the event unknown to the user is user orientation of the toy in a particular direction, and wherein the outer surface of said toy is shaped symmetrically with respect to a spatial center of said toy.

14. The puzzle apparatus of claim 13, wherein the latching rotor has magnets of one polarity in the direction of each push button, there being a magnet of the opposite polarity on the inner side of each said button.

15. The puzzle apparatus of claim 13, further comprising a weight attached to one respective shaft segment, wherein said user orientation of the toy causes the weight to rotate the respective latching rotor portion.

16. The puzzle apparatus of claim 14, wherein user pushing in of a push button out of the predetermined order causes the latching rotor to rotate about an axis, thereby resetting any latched buttons.

17. The puzzle apparatus of claim 16, further comprising a weight attached to a second respective shaft segment, wherein said user orientation of the toy causes the weight to rotate the respective latching rotor portion.

18. The puzzle apparatus of claim 17, wherein the shaft is moved along its axis to implement said reset mechanism, said movement causing the latching rotor to move off center thereby decoupling the magnetic connection between each pushed-in push button and the latching rotor.

19. The puzzle apparatus of claim 18, further comprising a reset button aligned along the shaft axis for initiating said reset mechanism.

20. The puzzle apparatus of claim 17, wherein the outer surface of the toy is a sphere and each of six push buttons is symmetrically spaced on the surface of the sphere, there being in addition a reset button located on the surface of the sphere.

* * * * *